US007183967B1

(12) United States Patent
Haendel et al.

(10) Patent No.: US 7,183,967 B1
(45) Date of Patent: Feb. 27, 2007

(54) SYSTEM AND METHOD FOR COMMUNICATING WITH AIRBORNE WEAPONS PLATFORMS

(75) Inventors: Richard S. Haendel, Iowa City, IA (US); Gary C. Waller, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 682 days.

(21) Appl. No.: 10/736,472

(22) Filed: Dec. 15, 2003

(51) Int. Cl.
*G01S 13/00* (2006.01)
*G01S 7/40* (2006.01)

(52) U.S. Cl. ..... 342/59; 342/58; 342/195

(58) Field of Classification Search ..... 342/25 R, 342/25 A, 25 B, 52, 58–60, 62, 66, 89, 90, 342/175, 176, 179, 189–191, 195, 196; 370/350, 370/454; 375/240.23, 240.28; 701/3, 6, 701/208, 220
See application file for complete search history.

(56) References Cited

U.S. PATENT DOCUMENTS 4,855,747 A * 8/1989 Steinberg ..... 342/179
5,539,408 A * 7/1996 Moreira et al. ..... 342/25 B
6,400,306 B1 * 6/2002 Nohara et al. ..... 342/25 R
7,106,243 B2 * 9/2006 Krikorian et al. ..... 342/25 B
7,136,726 B2 * 11/2006 Greenfeld et al. ..... 701/3
2004/0032878 A1 * 2/2004 Zogg et al. ..... 370/454
2004/0177377 A1 * 9/2004 Lin et al. ..... 725/81
2005/0111556 A1 * 5/2005 Endress et al. ..... 375/240.23
2005/0177307 A1 * 8/2005 Greefield et al. ..... 701/220

OTHER PUBLICATIONS

"Test and evaluation of the Rockwell Collins GNP-10 for the precision kill and targeting (PKAT) missile system", Renfroe, P.B.; McMinemon, J.D.; P.K.; Position Location and Navigation Symposium, IEEE Mar. 13-16, 2000 pp. 488-493.*

"Real-time discrimination of battlefield ordnance using remote sensing data", Hagerty, S.P.; Hillard, C.; Haralson, A.E.; Hibbeln, B.; Aerospace Conference Proceedings, 2000 IEEE vol. 3, Mar. 18-25, 2000 pp. 329-342.*

* cited by examiner

*Primary Examiner*—John B. Sotomayor
(74) *Attorney, Agent, or Firm*—Nathan O. Jensen; Kyle Eppele

(57) ABSTRACT

An airborne network configured to simultaneously transmit video imagery for battle damage indication from multiple airborne missiles to multiple tactical airborne non-launch aircraft.

20 Claims, 3 Drawing Sheets

SYSTEM AND METHOD FOR COMMUNICATING WITH AIRBORNE WEAPONS PLATFORMS

BACKGROUND OF THE INVENTION

The present invention generally relates to weapon data link systems, and more particularly relates to Tactical Targeting Network Technology (TTNT), and even more particularly relates to a system and method for communicating large amounts of data simultaneously to numerous battle group data users.

In the past, designers of battle group communication systems have endeavored to provide systems with improved abilities to simultaneously communicate information to numerous battle group users.

In the past, military communication equipment designers have developed several systems for battle group communication. The Joint Tactical Information Distribution System (JTIDS), also known as Link-16, has been used successfully in numerous combat situations. One much more recent, but widely accepted approach to enhancing battle group communication has been the use of Tactical Targeting Network Technology (TTNT), which involves using a fully interconnected radio network, which is configured to provide data, such as position and status information to numerous end users simultaneously. This method is currently being implemented and has been well received for its many advantages. Another widely used communication system employs point-to-point communication of video signals from a missile. The GBU15 is an example of a well-known bomb which provides video back to the launch platform, such as an F-15 fighter. This video can be used for bomb damage indication.

While these data communication systems each have advantages and each has been well accepted in the past, each has some shortcomings.

One problem with JTIDS (Link-16) is the very low data rate available for each user on the network. Link 16 cannot support more than 20 or 30 users on a network, while newer networks, such as TTNT, can support several thousand simultaneous users. Higher data rate networks such as IEEE 802.11 and others have limited distance capability. The communication system of the GBU15 weapon provides video communication back to the launch platform only and at limited distances. This is problematic because often it is not safe for the launch platform aircraft and crew to remain in the area until the video equipped missile reaches its target. In such cases, the launch platform aircraft is often forced to abandon communication and exit the area. When this occurs, the battle damage indication utility of the video communication is compromised, as the only unit that could receive the video information has left the area.

Consequently, there exists a need for improvement in systems and methods for simultaneously transmitting from an airborne missile, to multiple battle group users, video or other information of the type which requires high bandwidth transmissions at relatively long ranges.

SUMMARY OF THE INVENTION

It is an object of the present invention to efficiently simultaneously transmit video from a missile to multiple battle group users.

It is a feature of the present invention to utilize two separate communication systems—one for download to the missile, and the other, with a faster data rate, for upload from the missile.

It is an advantage of the present invention to better deliver tactical video images to multiple tactical users simultaneously.

It is another advantage of the present invention to provide for the ability to hand off control of an airborne missile to one of many non-launch platforms coupled to the TTNT network.

It is another feature of the present invention to permit simultaneous transmission and reception by the missile.

It is another advantage of the present invention to permit inter-loop control of the missile by a non-launch platform.

It is another advantage of the present invention to provide the ability of retargeting of a missile in flight from a tactical non-launch platform.

It is another advantage of the present invention to permit missiles to communicate with each other in flight.

The present invention is an apparatus and method for simultaneously communicating video and other high bandwidth requiring information from an airborne missile to multiple airborne tactical platforms, which is designed to satisfy the aforementioned needs, provide the previously stated objects, include the above-listed features and achieve the already articulated advantages. The present invention is carried out in a "point-to-point limitation-less system" in a sense that the requirement for a missile to exclusively communicate video imagery with its launch platform has been eliminated.

Accordingly, the present invention is a system and method for simultaneously up-linking video information from an airborne missile to a plurality of airborne tactical platforms.

BRIEF DESCRIPTION OF THE DRAWINGS

The invention may be more fully understood by reading the following description of the preferred embodiments of the invention, in conjunction with the appended drawing wherein.

DETAILED DESCRIPTION

Figure 1:
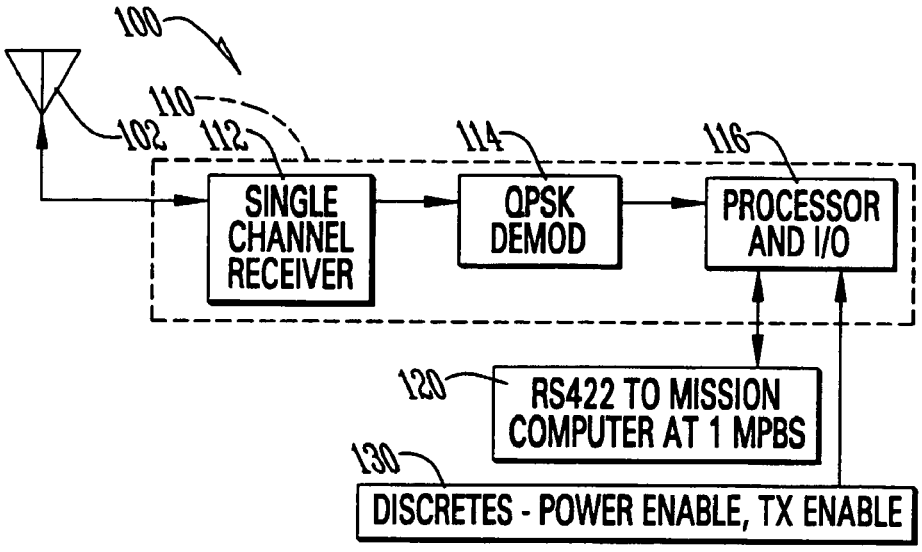
FIG.1 (PRIOR ART)
FIG. 1 is a simplified diagram of a prior art communication system for a missile of the type having a "receive only" option for missile control.

Now referring to the drawings wherein like numerals refer to like matter throughout, there is shown a receive only missile communication receiver system 100 of the prior art, which includes an antenna 102 which is coupled to and receives signals for receiver 112. Channel 110 is designated as the structure within the dashed lines. Receive only missile communication receiver system 100 comprises a single channel receiver 112, a quadrature phase shift keying (QPSK) demodulator 114, and a processor/input/output 116. The receive channel 110 receives input prior to commencement of delivery by discrete inputs 130 and data port 120. Data port 120 could be a two-way data port, such as an RS422 communication port, which could provide bidirectional data transfer with a mission computer at about 1 Mbps.

Figure 2:
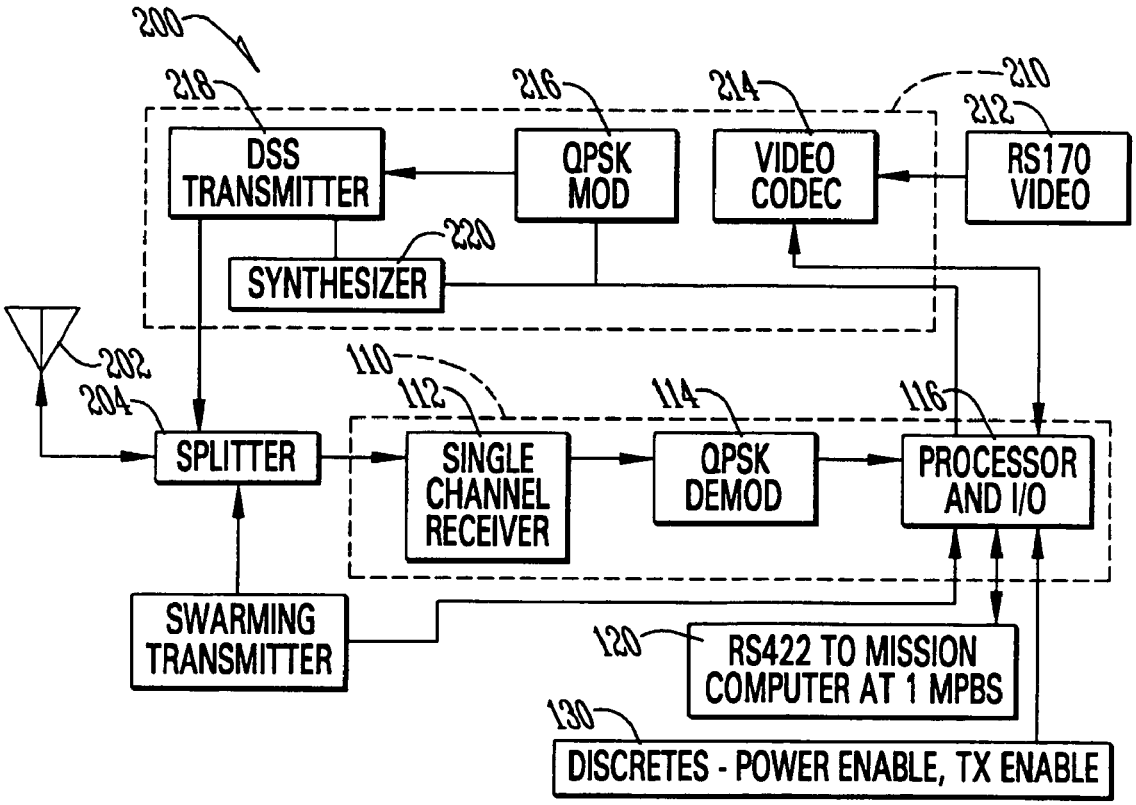
FIG. 2 is a simplified block diagram of the present invention showing a missile transceiver system which provides for up-linking or back-linking video from the missile.

Now referring to FIG. 2, there is shown a missile transmit and receive system, generally designated 200, including an antenna 202 and a splitter 204. Splitter 204 receives signals to be transmitted through antenna 202 from transmit channel 210. Transmit channel 210 is shown having a video surveillance data input port 212, which could accept video imagery from a video camera disposed on an airborne missile. The video imagery is processed by video coder/decoder CODEC 214, which provides digital data to processor/input/output 116, which provides a digital signal which, with the aid of quadrature phase shift keying modulator 216, Digital Spread Spectrum (DSS) transmitter 218, and synthesizer 220, is transmitted as an RF signal through antenna 202 to a remote receiver, such as a receiver on a TTNT network.

Figure 3:
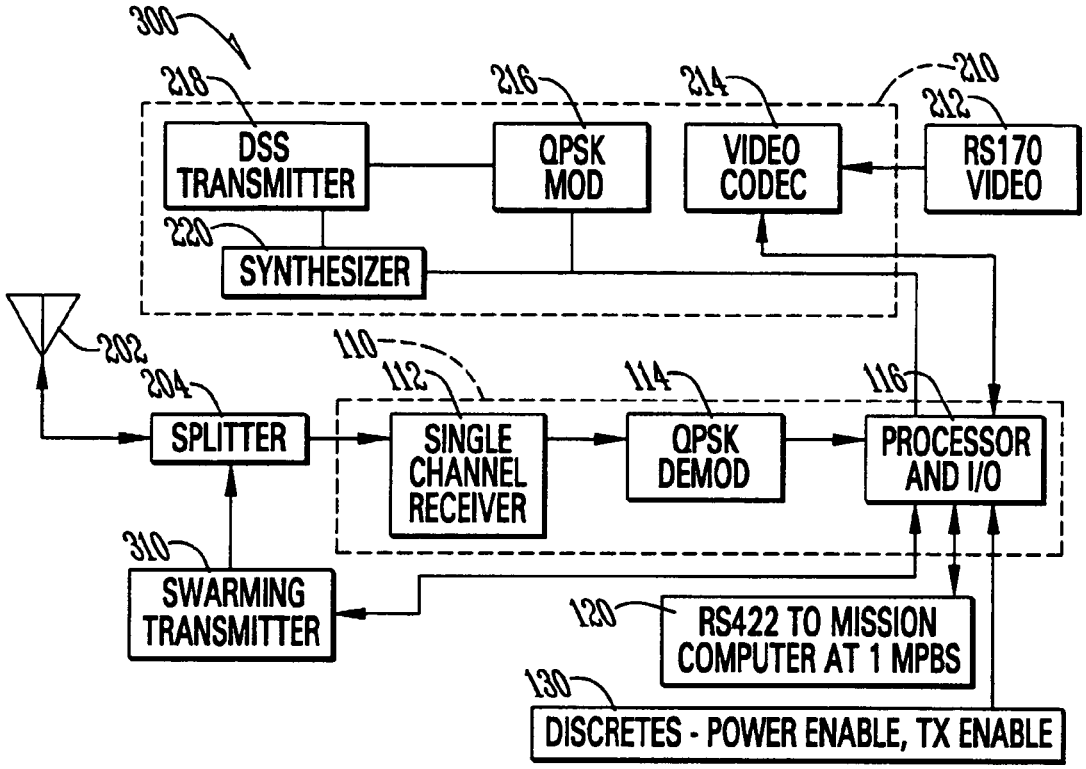
FIG. 3 is a simplified block diagram of a variation of the missile transceiver system of FIG. 2, which includes capability for inter-missile communication for self in-flight coordination of groups of missiles.

Now referring to FIG. 3, there is shown a variation of the system of FIG. 2 which provides for inter-missile communication, hereafter referred to as "swarming." The swarming missile system 300 includes a swarming transmitter which transmits signals which are capable of being received by single channel receiver 112 in other swarming missiles. The processor/input/output 116 provides a signal to the swarming transmitter 310, which transmits signals which are used by other swarming missiles to accomplish various tasks, such as in-flight reprogramming and targeting, in-flight dynamic prioritization of targets and other in-flight administrative, mission or control communications.

Figure 4:
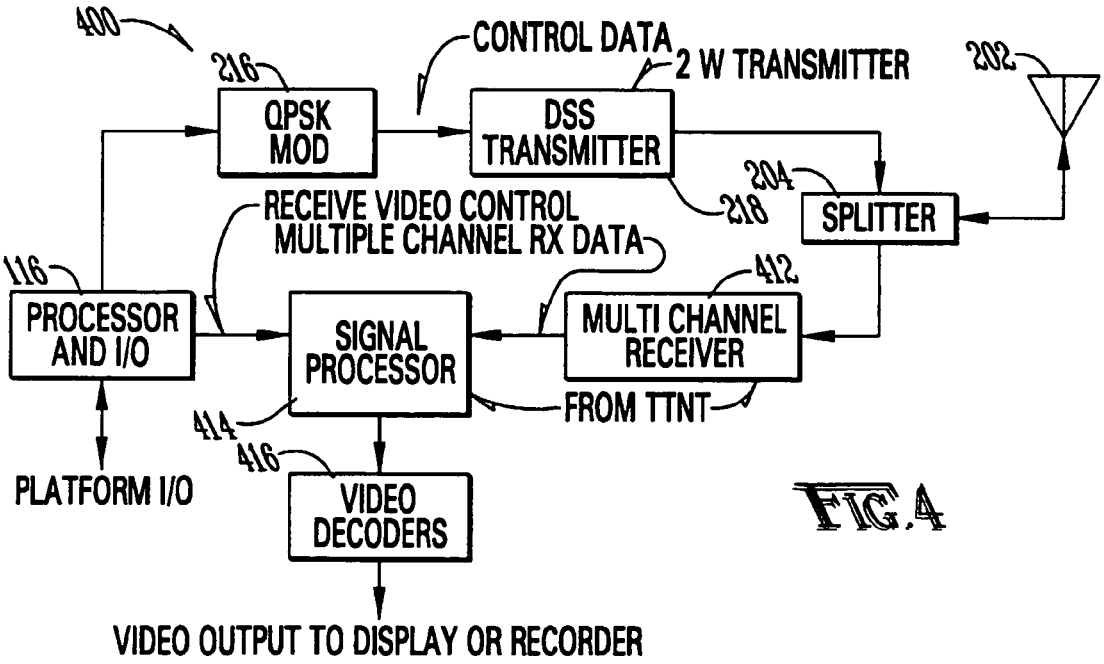
FIG. 4 is a simplified block diagram of a communication system of the present invention for use on a mobile tactical platform.

Now referring to FIG. 4, there is shown a transmit and multi-channel receive communication system 400, which would typically be used on a mobile tactical manned platform such as an aircraft, vehicle, etc. A multi-channel receiver 412 is included which provides for the ability to receive multiple messages simultaneously, such as is common with a TTNT network. The system 400 includes a signal processor 414 and video decoders 416 which could provide data to be displayed to a person or to be recorded for later analysis.

The following chart provides details of an exemplary embodiment of the weapon data link architecture of the present invention.

| | Aircraft to Weapon Downlink | Weapon to Aircraft Backlink |
|---|---|---|
| Information Data Rate | 100 kbps | 500 kbps/missile |
| Error Correction Encoding | Turbo code .793 | Turbo code .495 |
| Encoded RF Data Rate | 126 kbps | "Burst rate" of 3.75 Mbps/missile w/sync and header at 33% duty factor |
| RF Signal Type | CDMA | Digital Spread Spectrum (DSS) |
| Frequency Range | 1480 MHz | 1760–1850 MHz |
| Channels | 64 MHz (Qty - 1) | 2.5 MHz (Qty - 36) |
| Modulation | QPSK or GPSK | QPSK or GPSK |
| Output Power | 2 Watts | 10 Watts |
| Latency | <2 msec. | <2 msec. |
| Coding | PN | M-Sec, T-Sec |
| Analog Video Comp. | | MPEG-4 |

With the TTNT Weapon to Aircraft back-link design as described above, it is believed that the weapons data link of the present invention can support multiple weapons in the air. Because the system is designed for minimal latency, it is an asynchronous design. Therefore, the potential exists for the system to generate conflict between elements on the same frequency. However, the robust coding as embodied in the Digital Spread Spectrum structure resolves this potential conflict and provides for simultaneous data reception. The design is also designed with variable throughput, and, therefore, the following chart is provided to define a set of maximum limits of the system, when the system is configured as otherwise described.

| Frame Rate (388 × 262) (¼ VGA) (8 bit color) | Maximum Parallel Missile Video Links |
|---|---|
| 30 Frames per Second | 19 |
| 5 Frames per Second | 116 |

If two missiles are in the air and transmitting the maximum available bandwidth [1 Mbps information data or 7.5 Mbps RF data], the system would be expected to be at 1.8%, which is well below the system saturation point and will likely result in a transfer percentage of better than 99.95% per message.

Information Data Rate

Because of the limited power carrying capability of the weapon, it is believed that it may be best to consider reanalyzing the information data rate which directly affects the power consumption of the data link.

It is further believed that the aircraft to weapon downlink may be required for target reassignment and polling of the weapon. This typically could be accomplished via burst modes of less than 1 kbit of data. For the −2 (streaming video) variant of the return data link, utilizing the commercially available MPEG4-encoded stream format, may support 388×262 frames at 5 frames/sec using 200 kbps (including Turbocoding).

When the commercial of the shelf (COTS) error coding and video compression architectures are combined, it may result in a very low-cost, high capability weapon data link.

Security

One of the key areas that could affect cost is the data encryption and National Security Agency approval. The use of a governmentally approved cryptographic device is an extremely expensive component for this application ($1K per chipset in large volumes). Due to the limited life expectancy of the missile, it will be processing a very limited amount of secure data. When coupled with the desire for a very low-cost solution, it is believed that the secure processing should be handled by lower cost COTS technology. Triple DES encryption technology is already available in large volume and low cost. This encryption technology may be utilized for currency exchange, and, therefore, could be a trusted source of encryption. NSA is believed to be considering use of DES technology for low mission times.

Figure 5:
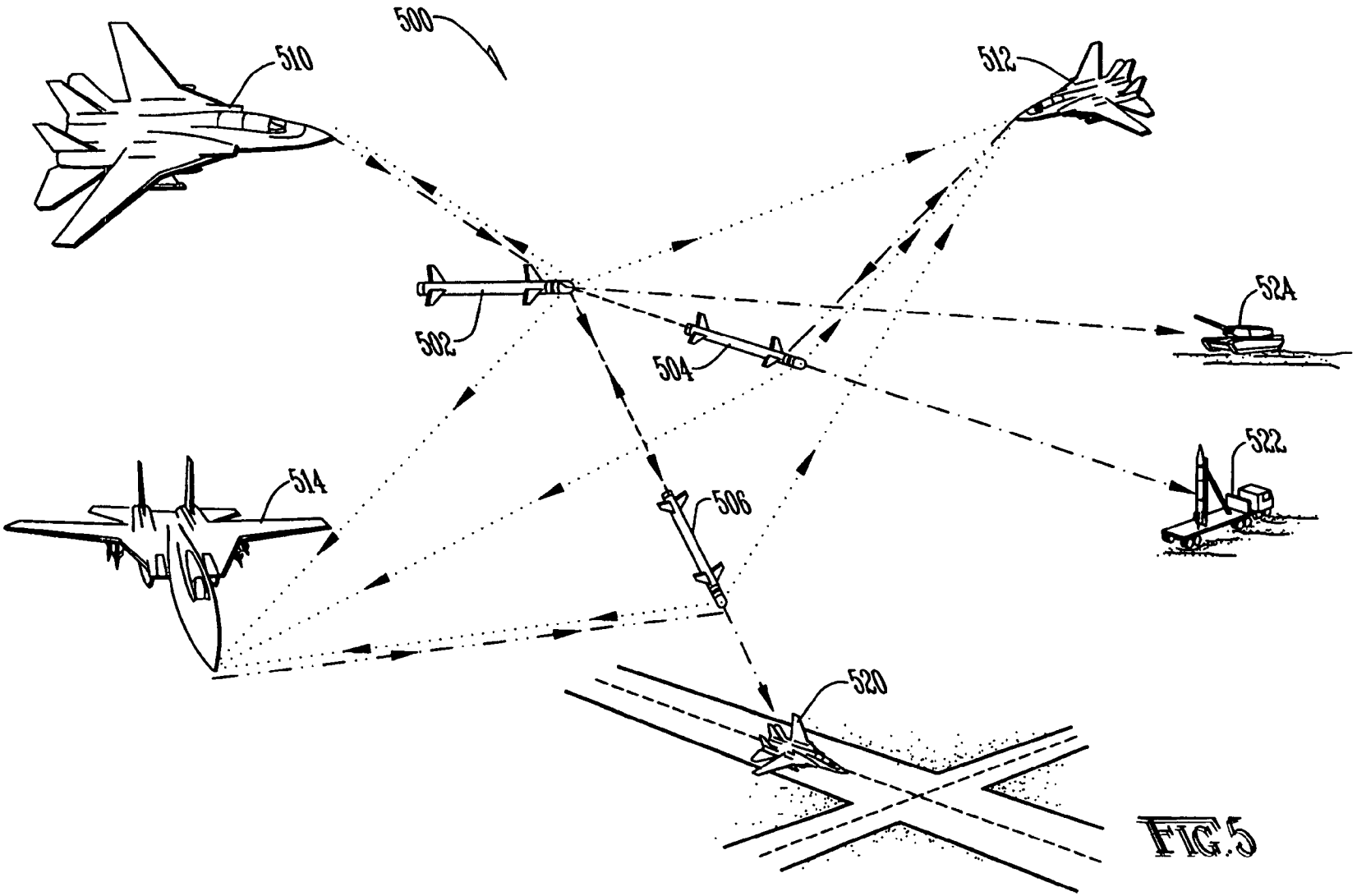
FIG. 5 is a simplified perspective view of a battle group of the present invention having the communication network of the present invention where the dotted lines show video communication from the missiles and the dashed lines show inter-missile communication while the dotted and dashed lines show the direction of surveillance from the missile. The dashed and doubled dotted lines refer to control signals to and from the missiles.

FIG. 5 depicts a battlefield scene, generally designated 500, where airborne missiles 502, 504, and 506 are broadcasting video signals to numerous battlefield platforms. These missiles may include equipment such as shown in FIGS. 2 and 3. The aircraft 510 may be viewed as the launching aircraft for each of the missiles and may include equipment as shown in FIG. 4. Aircraft 512 and 514 are non-launching aircraft which are within range to control the missiles 502, 504, and 506. They, too, may include equipment such as shown in FIG. 4. The missile 506 is depicted as being either out of range of aircraft 510 or oriented such as to no longer have communication with the aircraft 510. (There is no dotted line between them.) In such a scenario, the missile 506 would be controlled by either aircraft 512 or 514. Each missile has a forward looking surveillance system which is oriented toward one of the mobile targets 520, 522 or 524. These surveillance systems provide the video image signals which are received by the numerous aircraft. It is thought that the method and apparatus of the present invention will be understood from the foregoing description and that it will be apparent that various changes may be made in the form, construct steps and arrangement of the parts and steps thereof, without departing from the spirit and scope of the invention or sacrificing all of their material advantages. The form herein described is merely a preferred exemplary embodiment thereof.

We claim:

1. A battlefield communication system of the type having an interconnected tactical network such that a first mobile tactical platform is able to communicate location and status information simultaneously to a plurality of networked mobile tactical platforms, which are not mobile platforms from which said first mobile tactical platform is deployed; wherein the improvement comprises:

said first mobile tactical platform further comprising an explosive munition and a first multi-channel transceiver which is configured to simultaneously receive control signals and broadcast surveillance signals on to said interconnected tactical network;

wherein said surveillance signals comprise a real time video image of a surveilled area;

a second mobile tactical platform configured to receive said real time video image, via said interconnected tactical network;

a third mobile tactical platform configured to receive said real time video image simultaneously with said second mobile tactical platform, via said interconnected tactical network; and wherein said real time video image has a frame rate of at least four frames per second.

2. A system of claim 1 wherein each of said second mobile tactical platform and said third mobile tactical platform are not mobile tactical platforms from which said first mobile tactical platform was deployed.

3. A system of claim 2 wherein one of said second mobile tactical platform and said third mobile tactical platform communicate control signals with said first mobile tactical platform.

4. A system of claim 3 wherein said first mobile tactical platform is a non-ballistic missile.

5. A system of claim 4 wherein said control signals comprise a signal to detonate an explosive before impact.

6. A system of claim 1 further comprising:

a fourth mobile tactical platform comprising an explosive munition and a second multi-channel transceiver which is configured to simultaneously receive control signals and broadcast surveillance signals onto said interconnected tactical network;

wherein said fourth mobile tactical platform and said first mobile tactical platform being configured to directly communicate targeting information therebetween without a requirement to communicate through an intermediary.

7. A system of claim 4 further comprising:

a fourth mobile tactical platform comprising an explosive munition and a second multi-channel transceiver which is configured to simultaneously receive control signals and broadcast surveillance signals onto said interconnected tactical network; and wherein said fourth mobile tactical platform and said first mobile tactical platform being configured to directly communicate targeting information therebetween without a requirement to communicate through an intermediary.

8. A system of claim 1 wherein said second mobile tactical platform is an aircraft and wherein said control signals are output at a power level which is less than an output power level of said surveillance signals.

9. A system of claim 1 wherein said first mobile tactical platform is an air-launched non-ballistic missile.

10. A system of claim 9 wherein said control signal comprises a code division multiple access signal and said surveillance signals comprise a digital spread spectrum signal;

wherein each of said surveillance signals and said controls signals have a latency of less than two milliseconds.

11. A method of assessing damages inflicted in battle comprising the steps of:

transmitting a real time video image signal from an explosive missile, where said explosive missile was deployed from a first mobile platform; and simultaneously receiving and demodulating said real time video image signal at a plurality of receiving mobile platforms, each not being said first mobile platform.

12. A method of claim 11 wherein said first mobile platform is an aircraft.

13. A method of claim 11 wherein said step of transmitting a real time video image signal is done at a power level higher than a transmission power level of a code division multiple access control signal transmitted from said first mobile platform to said explosive missile.

14. A method of claim 13 wherein said real time video image signal comprises a digital spread spectrum signal.

15. A method of claim 14 wherein said real time video image signal and said code division multiple access control signal each have a latency of less than two milliseconds.

16. A method of claim 15 wherein said real time video image signal has an information data rate more than twice as high as an information data rate of said code division multiple access control signal.

17. A method of claim 16 wherein said real time video image signal has an information data rate more than four times as high as an information data rate of said code division multiple access control signal.

18. A method of claim 17 further comprising the steps of:

receiving a targeting control signal directly from a second explosive missile; wherein said targeting control signal at least partially defines a planned flight characteristic of an explosive missile.

19. A method of claim 11 wherein said explosive missile responds, in flight, to control signals from said first mobile platform and subsequently switches a source of said control signal to a second mobile platform.

20. A system comprising:

a first aircraft configured to launch explosive missiles and to control explosive missiles in flight, via two-way communication;

a second aircraft configured to launch explosive missiles and to control explosive missiles in flight, via two-way communication;

a third aircraft configured to launch explosive missiles and to control explosive missiles in flight, via two-way communication;

a first airborne explosive missile comprising a forward looking surveillance system, configured to simultaneously transmit digital spread spectrum real time video signals of a target to one of said first aircraft, said second aircraft, and said third aircraft which is not an aircraft from which said first explosive missile has been launched, and receive a code division multiple access control signal with a latency of less than two milliseconds from said one of said first aircraft, said second aircraft, and said third aircraft which is not an aircraft from which said first explosive missile has been launched;

a second airborne explosive missile comprising a forward looking surveillance system, configured to simultaneously transmit digital spread spectrum real time video signals of a target to one of said first aircraft, said second aircraft, and said third aircraft which is not an aircraft from which said second explosive missile has been launched, and receive a code division multiple access control signal with a latency of less than two milliseconds from said one of said first aircraft, said second aircraft, and said third aircraft which is not an aircraft from which said second explosive missile has been launched;

a third airborne explosive missile comprising a forward looking surveillance system, configured to simultaneously transmit digital spread spectrum real time video signals of a target to a one of said first aircraft, said second aircraft, and said third aircraft which is not an aircraft from which said third explosive missile has been launched, and receive a code division multiple access control signal with a latency of less than two milliseconds from said one of said first aircraft, said second aircraft, and said third aircraft which is not an aircraft from which said third explosive missile has been launched;

wherein each of said code division multiple access signals has a transmit power level which is less than one-fourth of a transmit power level of each of said digital spread spectrum real time video signals; and, wherein each of said first explosive missile, said second explosive missile and said third explosive missile further comprises a transmitter configured for directly communicating targeting information between said first explosive missile, said second explosive missile and said third explosive missile, so that each missile can be reprogrammed for a different target after having been launched from one of said first aircraft, said second aircraft, and said third aircraft.

* * * * *